United States Patent [19]

Doke et al.

[11] Patent Number: 4,588,156

[45] Date of Patent: May 13, 1986

[54] INTEGRAL BRACKET SUPPORT STRUCTURE

[75] Inventors: Jack Doke, Walnut; Forrest E. Clemens, Sherman Oaks, both of Calif.

[73] Assignee: Clemco Roll Forming, Inc., City of Industry, Calif.

[21] Appl. No.: 621,255

[22] Filed: Jun. 15, 1984

[51] Int. Cl.[4] ..... A47G 29/02

[52] U.S. Cl. ..... 248/243; 248/247; 52/36; 52/730

[58] Field of Search ..... 248/243, 247, 248, 297.2; 52/36, 730, 301; 24/373

[56] References Cited

U.S. PATENT DOCUMENTS

| | | | |
|---|---|---|---|
| 3,305,981 | 2/1967 | Biggs | 52/36 |
| 3,394,507 | 7/1968 | Doke | 52/36 |
| 3,407,547 | 10/1968 | Doke | 52/36 |
| 3,492,766 | 2/1970 | Andrews | 52/36 |
| 3,509,669 | 5/1970 | Plemeng | 52/36 |
| 3,565,152 | 2/1971 | Cohn | 160/135 |
| 3,648,419 | 3/1972 | Marks | 52/36 |
| 3,668,827 | 6/1972 | Schwartz | 52/36 |
| 3,714,748 | 2/1973 | Costruba | 248/243 |
| 3,730,477 | 5/1973 | Wavrunek | 248/243 |
| 3,791,709 | 2/1974 | Cross | 248/300 |
| 3,828,495 | 8/1974 | Law | 52/36 |
| 4,370,838 | 2/1983 | Vermillion | 52/36 |
| 4,441,300 | 4/1984 | Varon | 211/87 |

*Primary Examiner*—J. Franklin Foss
*Assistant Examiner*—Robert A. Olson
*Attorney, Agent, or Firm*—Elliott N. Kramsky

[57] ABSTRACT

A bracket support structure adaptable to a wall of a the type that includes a frame formed of a plurality of elongated vertical studs for attaching at least one sheetlike panel. The bracket support comprises a single integral structure that includes a lateral channel for receiving a slotted bar support, an inwardly-projecting closed recess for accommodating the inner end of a wall bracket and a passageway formed between spaced-apart, exteriorly-directed blade members. Clips are attachable to the top and the bottom of support housing, such clips serving as both fire stop plates and as means for applying inwardly-directed pressure on the blades defining the passageway to enhance lateral stability of the bracket when mounted.

2 Claims, 5 Drawing Figures

INTEGRAL BRACKET SUPPORT STRUCTURE

BACKGROUND

1. Field of the Invention

The present invention relates to bracket supports of the type that are commonly employed in certain wall structures, such as partitions that include a plurality of spaced vertical studs defining the wall frame. More particularly, the invention herein pertains to a substantially integral support that offers significant economic advantages over conventional structures.

2. Description of the Prior Art

An often-utilized wall construction that is particularly favored by retail business establishments and offices includes a frame formed by a plurality of spaced, vertically arranged wall studs. Often such studs are metallic and generally U-shaped in cross section, opposed flanges providing strength and anchor points for the wallboard panel surfaces of the partition-type wall units. Construction of this type is almost universally employed at the present time in the division of office space into tenants' preferred anrrangements as it is both economical and semipermanent, allowing easy rearrangement for new occupants.

Commonly, shelf space adjacent the partition is desired. Thus, a series of wall shelves will be provided, each shelf positioned at a right angle to the wallboard surface. These shelves are usually supported by brackets that protrude from and are anchored in some manner within the partition.

A number of arrangements have been provided in the past for properly mounting such brackets securely. The bracket support must provide adequate resistance to the weight and bending moments that are transferred to it in consequence of the loading of the cantilevered wall shelves. Further, the geometry of such support must be fully compatible with the wall unit and studs.

A common bracket supporting mechanism generally includes an elongated, often slotted, core member of bar steel or the like. The slots in this member are intended to engage a mating tongue that projects inwardly at the inner end of the conventional wall bracket. A critical feature of the overall bracket support pertains to the mode of securing the slotted support bar to the wall. Such apparatus, often an elongated housing, must not only accommodate the slotted core member in a secure manner but also be compatible with the wall unit and the bracket. Means must be provided to stabilize the core member both laterally and vertically as it is not inherently stable. Further, ready access to the slots of the core member and the enhancement of bracket stability are quite desirable.

The multiple requirements of a bracket support design have resulted in a number of solutions. Generally, such designs have included a vertical channel for retaining the bracket support core or bar. Numerous configurations have been employed for cooperatively engaging such channel to the remainder of the wall unit. Examples of designs that include an upright channel for receiving a slotted support bar and that are adapted to be secured to a wall are disclosed in the following U.S. patents: U.S. Pat. NO. 3,714,748 of Costruba for "Support Structure for Shelving" issued Feb. 6, 1973; U.S. Pat. No. 3,730,477 of J. R. Wavrunek for "Bracket Support Unit for Integral Wall Construction" issued May 1, 1973; U.S. Pat. No. 3,492,766 of W. R. Andrews for "Adjustable Stud" issued Feb. 3, 1970; U.S. Pat. No. 3,509,669 of G. J. Plemeng for "Support Structure for Shelving" issued May 5, 1970; U.S. Pat. NO. 3,407,547 of J. Doke et al. for "Metallic Wall Stud Structure for Supporting Shelf Brackets" issued Oct. 29, 1968; and U.S. Pat. No. 3,394,507 of J. Doke for "Metallic Structure for Interior Walls to Carry Shelf Brackets and Wallboard" issued July 30, 1968.

A critical feature of a practical support design is cost, both of manufacture and of upkeep as wall units are designed for economy. Related to economy of upkeep is the inherent reliability of a design. The bracket supports disclosed in the Costruba, Andrews and Plemeng patents employ angle bars, spot welded to the core support bar, to define a stabilizing outwardly-protruding passageway for the bracket. The angle bars form, with the support bar, a slidable arrangement within the upright channel formed inside the bracket support housing. While such a passageway is advantageous both in terms of bracket stability and protection of the surrounding drywall from chipping and fraying, this type of construction requires numerous fabrication steps and results in a structure that includes numerous welds subject to fracture.

The Wavrunek patent discloses a bracket support in which the passageway is formed of a molded piece integral with an upright housing including an interior channel. However, the increased reliability of this design is achieved only at the cost of the substantial added fabrication costs that result from the extrusion process as opposed to more economical processes such as cold rolling and the like.

SUMMARY OF THE INVENTION

The disadvantages of the prior art set forth above and others are addressed and overcome by the present invention which provides an elongated housing for receiving an elongated support bar having a plurality of slots to engage the inner end of at least one wall bracket. Such housing, which is adapted to be secured to a closely-spaced pair of wall studs, includes a horizontal section that is substantially T-shaped and includes a laterally disposed channel for receiving the support bar, an inwardly projecting closed recess for accommodating the inner end of such wall bracket(s) and an open, outwardly projecting passageway for laterally stabilizing the wall bracket.

The laterally disposed channel provided by the invention comprises opposed flanges, each of which includes opposed, spaced apart lateral members integral with an inwardly disposed member forming a general U-shape. The passageway comprises opposed, spaced apart outwardly-projecting blades, each of which is integral with a lateral member forming one of the flanges. Finally, the closed recess provided by the invention comprises spaced apart, inwardly projecting members integral with a transverse lateral member to form a generally U-shaped configuration. Each of the inwardly-projecting members is integral with one of the lateral members forming the flanges so that the elongated housing comprises a unitary configuration.

In a further aspect, the invention provides an improved bracket support structure. This structure includes an elongated roll formed housing comprising a single integral structure. Such structure includes a laterally disposed channel for receiving a bracket support bar, an inwardly-projecting closed recess for accommodating the inner end of at least one wall bracket and an open, outwardly-projecting passageway for lateraly stabilizing the bracket. In addition, means are provided for applying an inwardly-directed force upon such passageway.

The foregoing and additional features and advantages of the invention will become further apparent from the detailed description that follows. This description is accompanied by a set of drawing figures. Common numerals of the written description and the figures are associated with common features of the invention, like features of the invention being associated with like numerals throughout both the written description and the drawing figures.

DETAILED DESCRIPTION

Figure 1:
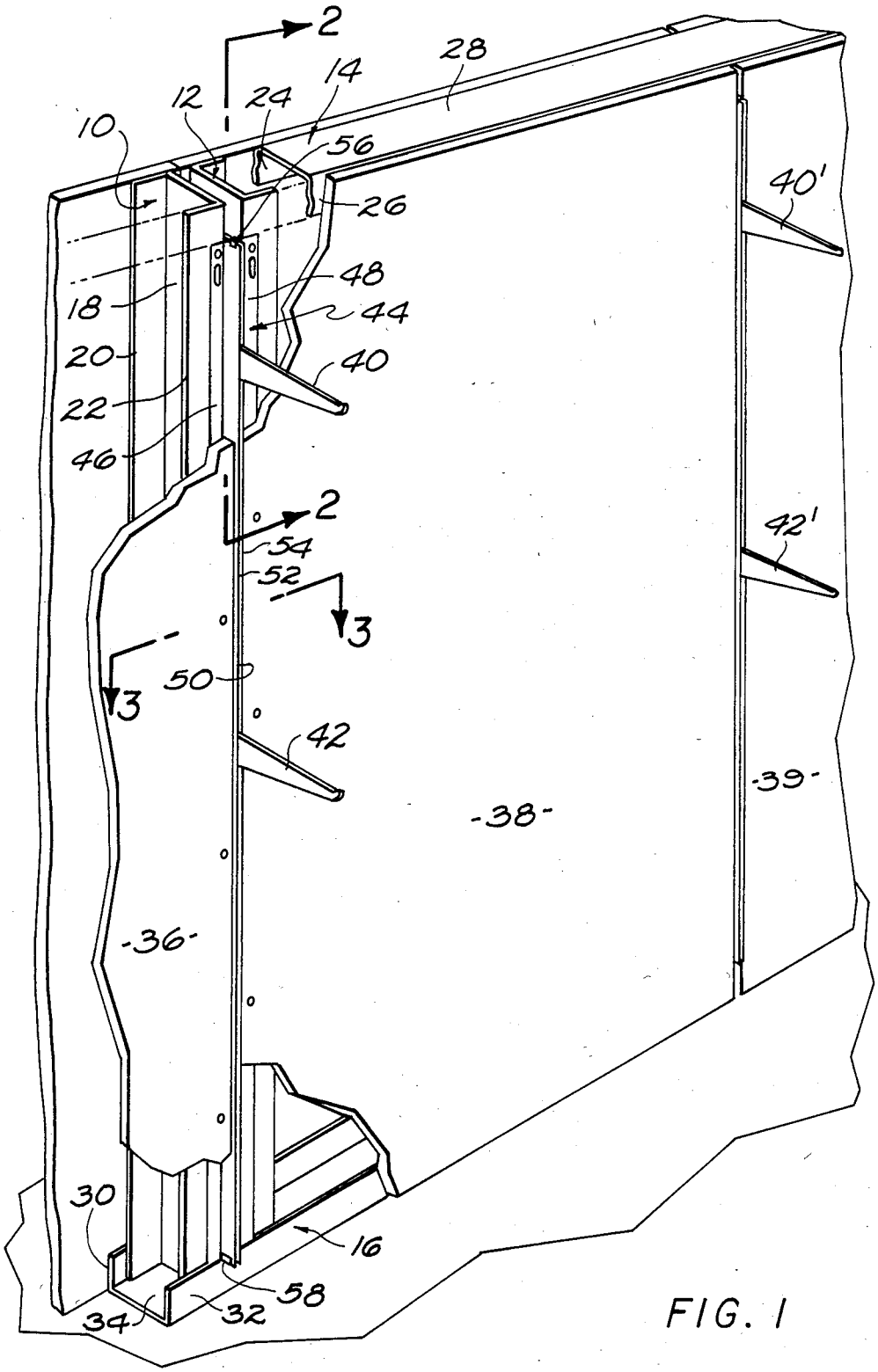
FIG. 1 is an overall partially broken perspective view of a wall unit, such as a partition, incorporating a bracket support in accordance with the invention.

Turning now to the drawings, FIG. 1 illustrates a wall unit of the type to which the present invention may be readily adapted. Such construction is prevalent and commonly found in retail establishments and office suites, walls of the nature described below providing semi-permanent partitions of otherwise barren office space.

The wall unit includes a metallic frame formed of regularly spaced pairs of elongated vertical wall studs 10, 12 fixed, at their upper and lower extremities, respectively, to a cap 14 and a track 16. Any of a number of conventional means may be employed, including screws, brads, spot welds or the like, for affixing the studs to the cap 14 and to the track 16.

As shown in FIG. 1, the wall studs 10 and 12 are generally U-shaped, comprising, in the "back-to-back" arrangement disclosed, a web 18 intermediate outwardly-directed flanges 20 and 22. Likewise, both the cap 14 and the track 16 shown are generally U-shaped, the cap 14 including downwardly-directed flanges 24 and 26 integral with a web 28 defining the top of the wall unit and the track 16 including upstanding flanges 30 and 32 formed with a web 34 defining the bottom of the wall.

The various flanged members provide locations for attachment of wallboard sections 36, 38 and 39. Once again, a number of conventional fastening means such as nails, staples, screws and the like may be employed to secure the drywall sections to the frame formed of the cooperative arrangement of studs, cap and track.

The wall construction of FIG. 1 is generally similar to and of like configuration with that disclosed in the Costruba patent and others. The present invention will be shown to be compatible therewith and to numerous variations thereof. The prime utility of the invention arises from common need to support at least one pair of cantilevered, load-bearing wall brackets such as 40, 40' or 42, 42' from the wall. Such brackets support the shelving commonly required for product display (retail business), bookshelves (office), general storage and numerous other uses.

The bracket support of the invention is shown generally at 44. As can be seen, the support 44 includes laterally-directed mounting flanges 46 and 48 that are fixed to the outwardly-directed flanges of the closely-spaced elongated wall studs 10 and 12. The brackets enter the inwardly-directed portion of the support 44 (shown clearly infra) through a longitudinal passageway 50 that is formed between a pair of exteriorly-directed, spaced-apart blade members 52 and 54. Upper and lower caps 56 and 58 respectively, cooperate with the support 44 to stabilize the support mechanism, provide fire stops and secure an elongated slotted support bar (not shown in FIG. 1).

Figure 2:
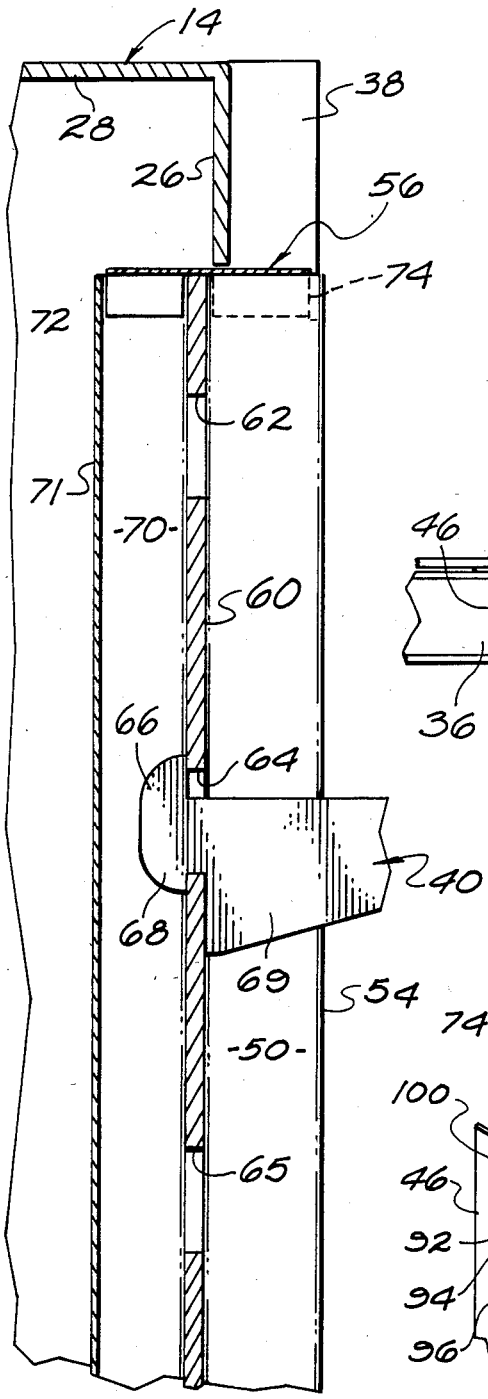
FIG. 2 is an enlarged side elevation view taken along the section line 2—2 of FIG. 1 illustrating the manner of retention of a wall bracket by the invention.

FIG. 2 is an enlarged elevation view taken along the section line 2—2 of FIG. 1. As mentioned above, an elongated bar 60 is positioned within the support member that includes a plurality of lengthwise-spaced slots 62, 64, 65 adapted to engage the inner end of a shelf bracket 40. As shown, the inner end of the shelf bracket 40 includes upper and lower tongues 66 and 68 and a stabilizer 69 that assure the stability of a load-bearing shelf in the vertical plane.

An inwardly-directed recess 70 is formed at the rear of the bracket support between the support bar 60 and the back wall 71 of the support. The recess allows sufficient room behind the inner end of the shelf bracket 40 for the bracket to be easily inserted and/or removed from the supporting slots of the bar 60. As should be evident, removal and/or insertion requires the tilting of the bracket to accommodate passage of the upper and lower tongues 66 and 68 through the slot 64.

The upper cap 56 includes downwardly-directed wings 72 and 74 that allow the cap 56 to be securely clipped to the top of the support. The rear wing 72 (one of a pair) is fitted within the support at the recess 70 while, at the same time, the front wing 74 (also one of a pair) exerts inwardly-directed pressure on the blade member 54 that forms one side of the exteriorly-directed passageway 50 shown in FIGS. 3 and 4. The clips enhance the lateral stability of an inserted shelf bracket by exerting inwardly-directed pressure on spaced-apart blade members that form the passageway and outwardly-directed pressure at the rear of the support. This combination of pressures exerts an inward torque on the paired blades.

Figure 3:
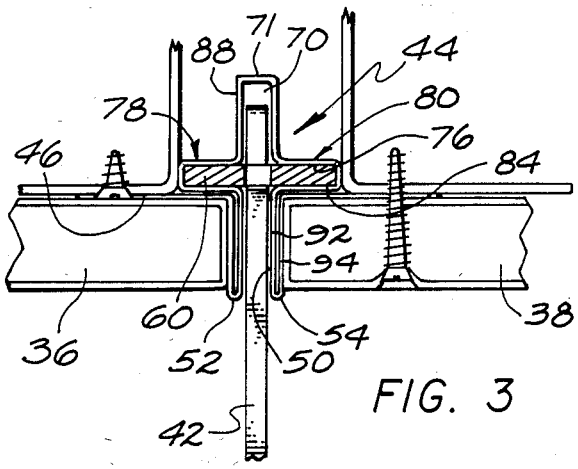
FIG. 3 is an enlarged top view of the housing of the invention taken along section 3—3 of FIG. 1.

FIG. 3 is a sectional view of the bracket support taken at line 3—3 of FIG. 1. The cross sectional geometry of the bracket support is shown clearly in this view. The entire support unit, with the exception of the upper and lower clips, is formed of a single piece of cold rolled sheet steel or sheet metal, providing significant and obvious advantages over conventional support units that require, for example, spot welding of component parts to form a composite unit, extrusion, extensive machining and the like.

In addition to the inwardly-directed recess 70 and the exteriorly-directed passageway 50 already disclosed, the support includes a laterally-directed channel 76 for receiving the support bar 60. The channel is defined by opposed lateral flanges 78 and 80, each formed of spaced-apart lateral members 82 and 84 integral with an inwardly-disposed member 86 in a generally U-shape. Lateral member 82 is, in turn, roll formed integral with an inwardly-projecting member 88 that forms one of the sidewalls of the recess 70. Each of the opposed lateral members is, in turn, roll formed integral with the back wall 71.

The passageway 50 admits the bracket within the wall so that its inner end may engage the slots of the support bar. The substantial length of the relatively narrow passageway 50 provides lateral stability for the bracket while protecting the exposed edges of the wallboard partition sections 36 and 38 from the frictional forces that occur when the bracket is inserted and/or removed from the wall.

Passageway 50 is defined by spaced-apart bladelike members 52, 54. Each of the members 52, 54 includes an inner portion 92 and reversely-folded outer portion 94. The inner portion is integral with the lateral member 84 of flange 78. The outer portion 94 is roll formed integral with the inner portion 92 and with a laterally-directed longitudinal attachment flange 46. An identical construction obtains with respect to the reversely folded blade member 54. The opposed lateral attachment flanges 46 and 48 are secured to the outer flanges of the wall studs by conventional fastening means including but not limited to rivets, bolts, screws, nails, welds or the like.

Figure 4:
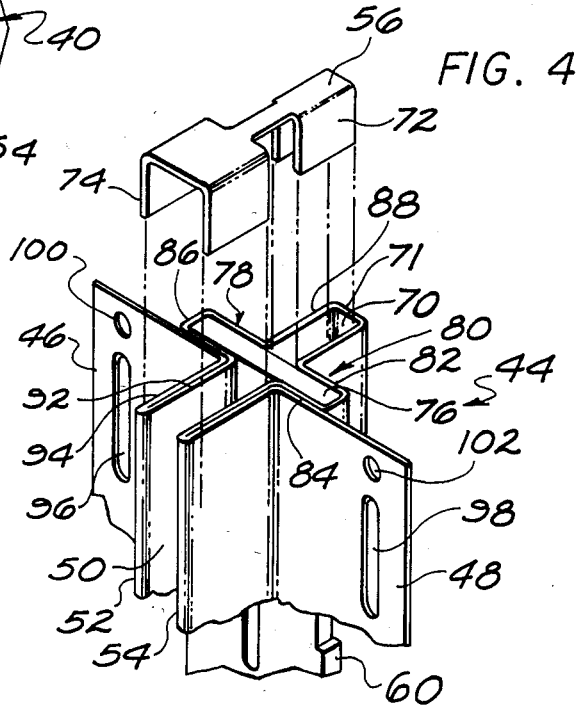
FIG. 4 is an exploded perspective of an end portion of the elongated housing illustrating the end cap thereof for assisting the lateral stability of a shelf bracket.

FIG. 4 is an exploded perspective view of the invention including the unitary, roll formed support, upper clip 56 and support bar 60. As will be appreciated from this view and from the preceding discussion, the invention comprises a comprehensive unit for securing and stabilizing load-bearing cantilevered shelves adjacent a partition-like wall unit. The auxiliary clips further enhance the lateral stability afforded by the unit by applying additional inwardly-directed force upon the passageway 50. Unlike prior art bracket support housings and their equivalents, the present invention, while comprehensively addressing the significant parameters required of apparatus for securing a bracket to a wall construction of the type disclosed, achieves significant economies that are not realized by a non-unitary extruded or machined structure.

A further economy, that of rapid, accurate and facile installation of the support 44 with respect to the wall studs forming the frame of the partition is achieved by the present invention. Vertical slots 96, 98 are formed within the laterally-directed mounting flanges 46 and 48 respectively. Associated with each of the slots is a hole 100 or 102 for accepting a self tapping sheet metal screw of cross section substantially coextensive with the area of such hole.

The slots 96 and 98 (and corresponding slots—and holes—located adjacent the bottom of each bracket support) are provided for accepting screws to form a slidable relationship, upon application of a moderate amount of pressure, between the bracket support and adjacent wall studs. Such a relationship is highly desirable during installation. Generally, a "water line" is marked near the bottom of each wall stud, each water line denoting a true level and optimum installation requires that the bottom of each bracket support coincide with the water line of the studs to which the support is attached.

Even an experienced installer will find it difficult and awkward to attend to matching the bottom of a bracket support to the water line markings at the same time he is affixing or securing the support to the studs. The present invention greatly alleviates this dilemma. By inserting screws initially only into the slots of the flanges 46 and 48, the installer need not attain great accuracy in matching the water line. Rather, by applying some pressure to either the top or the bottom of the support (by means of a hammer, for example) it can be positioned with great accuracy after initial placement. When such accuracy has been attained, screws may then be inserted into the holes that are associated with the slots, permitting the exact position of the support to be secured or anchored against movement. In addition, the screws within the slots may be further tightened down after final adjustment, enhancing the permanence of the setting.

Figure 5:
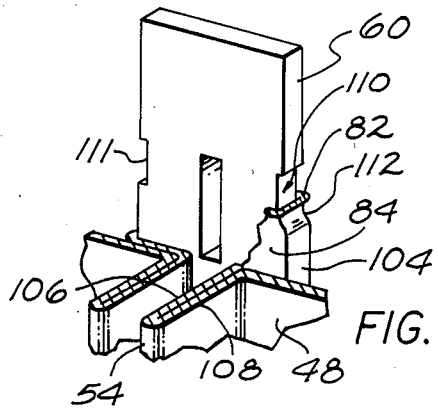
FIG. 5 is an enlarged, partially broken perspective view which details the manner in which the vertical position of the support bar is secured within the laterally-directed channel of the bracket support.

While the laterally-directed channel 76 of the support 44 is closely roll-formed about the support bar 60 so that a substantial frictional force exists therebetween, the vertical position of the bar 60 is absolutely secured by the arrangement shown most clearly in FIG. 5. This figure provides an enlarged, partially broken perspective view of the manner in which the vertical position of the support bar 60 is effectively "locked" within the channel 76.

As is shown in FIG. 5, the unitary form of the bracket support is roll formed about the slotted bar 60 to form the upright lateral channel defined, in part, by a laterally-directed flange including the lateral members 82 and 84 and the connecting inwardly-projecting member 104. As discussed above, the lateral member is integral with the inner and outer portions 106 and 108 respectively that form the blade member 54 that is, in turn, integral with the laterally-directed mounting flange 48.

Side notches 110 and 111 are formed in pairs along the length of the support bar by a stamping or like process. The notches act on reduced sections for roll forming a corresponding plurality of paired indentations, such as the indentation 112, onto the inwardly-projecting member 112 (and corresponding member 86). The indentations act as flanges that, in combination with the side notches of the slotted bar 60, form a secure interlocking functional unit. Thus, the user may place large loads on the bracket pairs 40, 40' and 42, 42' without worry regarding slippage of the unwelded support bar 60 within the bracket support 44.

Thus it is seen that there has been brought to the art new and improved apparatus for securing a load bearing shelf bracket to a wall of the type comprising a frame of spaced vertical studs. While the invention has been described in its presently preferred embodiment, it is not intended that it be limited to such embodiment. Rather, it is only limited as defined by the following set of claims and equivalents thereof.

What is claimed is:

1. A bracket support structure comprising, in combination:

a. an elongated roll formed housing comprising a single integral structure including a laterally disposed channel for receiving a bracket support bar, an inwardly-projecting closed recess for accommodating the inner end of at least one wall bracket and an open, outwardly projecting passageway for laterally stabilizing said bracket; and b. at least one clip for engaging an end of said housing, said clip including two opposed pairs of wings, said pairs of wings being arranged to provide outwardly-directed pressure upon the lateral walls of said closed recess and inwardly-directed pressure upon said outwardly-projecting passageway.

2. A bracket support as defined in claim 1 further characterized in that said laterally disposed channel includes at least one indentation for interlocking with said support bar.

* * * * *